US007597151B2

(12) United States Patent
Curtis et al.

(10) Patent No.: US 7,597,151 B2
(45) Date of Patent: Oct. 6, 2009

(54) HYDRAULICALLY OPERATED FORMATION ISOLATION VALVE FOR UNDERBALANCED DRILLING APPLICATIONS

(75) Inventors: Fredrick D. Curtis, Houston, TX (US); Ronald Hyden, Spring, TX (US); Michael Harvey, Granite Shoals, TX (US); Jimmie R. Williamson, Jr., Carrollton, TX (US); James D. Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 54 days.

(21) Appl. No.: 11/180,140

(22) Filed: Jul. 13, 2005

(65) Prior Publication Data

US 2007/0012457 A1 Jan. 18, 2007

(51) Int. Cl.
*E21B 34/14* (2006.01)

(52) U.S. Cl. ..... 166/373; 166/66.5; 166/332.4; 166/386

(58) Field of Classification Search ..... 166/332.4, 166/332.8, 386, 373, 66.5
See application file for complete search history.

(56) References Cited

U.S. PATENT DOCUMENTS 4,574,889 A 3/1986 Pringle
4,579,177 A * 4/1986 Going, III ..... 166/66.5
4,606,416 A 8/1986 Knighton et al.
5,249,630 A 10/1993 Meaders et al.
5,257,663 A * 11/1993 Pringle et al. ..... 166/66.4
5,531,270 A 7/1996 Fletcher
6,041,864 A * 3/2000 Patel et al. ..... 166/332.4
6,142,226 A 11/2000 Vick
6,152,232 A 11/2000 Webb et al.
6,167,974 B1 1/2001 Webb
6,343,649 B1 2/2002 Beck
6,343,658 B2 2/2002 Webb
6,557,637 B1 5/2003 Dore et al.
6,659,186 B2 * 12/2003 Patel ..... 166/386
6,684,950 B2 2/2004 Patel
6,962,215 B2 11/2005 Curtis et al.
6,988,556 B2 1/2006 Vick
2003/0019622 A1 1/2003 Goodson (Continued)

OTHER PUBLICATIONS

Weatherford Drilling & Intervention Services, "Underbalanced Drilling: Undeniable Success," dated Mar. 2002.

(Continued)

*Primary Examiner*—Shane Bomar
(74) *Attorney, Agent, or Firm*—Smith IP Services, P.C.

(57) ABSTRACT

A formation isolation valve for underbalanced drilling applications. A system for operating a formation isolation valve includes the valve interconnected in a casing string. An assembly displaces through the casing string, thereby causing the valve to open prior to the assembly reaching the valve. An operating system includes a well tool with an actuator positioned downhole. A device for causing the actuator to operate the well tool is also positioned downhole remote from the actuator. A method of operating a well tool includes the steps of: positioning the well tool in a well, the well tool including an actuator; positioning a power source for the actuator in the well; and at a downhole position remote from the actuator, causing the actuator to operate the well tool.

15 Claims, 4 Drawing Sheets

U.S. PATENT DOCUMENTS

| | | | | |
|---|---|---|---|---|
| 2003/0150622 | A1* | 8/2003 | Patel et al. | 166/373 |
| 2003/0155131 | A1* | 8/2003 | Vick, Jr. | 166/375 |
| 2005/0230118 | A1 | 10/2005 | Noske | |
| 2005/0263286 | A1* | 12/2005 | Sheffield | 166/297 |

OTHER PUBLICATIONS

Weatherford Products & Services Catalog, title page, p. 24 including "Underbalanced Downhole Tools," and back page, dated 2002.

Halliburton brochure entitled, "Quick-Trip Valve Making Underbalanced Operations Easier and Safer," dated Apr. 2002.

Weatherford, "A Year of Milestones for Your Company", 2002.

PES, "Model DV Dual Control Line Operated Drill Through Lubricator Valve", Jul. 27, 2001.

Office action for U.S. Appl. No. 10/426,917 dated Feb. 10, 2005.

A series of three illustrations showing a drill bit being conveyed through a valve interconnected in a tubular string in a well.

International Preliminary Report on Patentability and Written Opinion Issued for International Patent Application No. PCT/US06/23947 dated Jan. 24, 2008 (6 pages).

* cited by examiner

HYDRAULICALLY OPERATED FORMATION ISOLATION VALVE FOR UNDERBALANCED DRILLING APPLICATIONS

BACKGROUND

The present invention relates generally to operations performed and equipment utilized in conjunction with a subterranean well and, in an embodiment described herein, more particularly provides a formation isolation valve for use in underbalanced drilling applications.

A formation isolation valve is typically used in underbalanced drilling operations to close off flow through a casing string while tripping a drill string, or otherwise when access to a wellbore below the valve is not required. The valve is opened when the drill string or other assembly (such as wireline tools, coiled tubing string, etc.) needs to be displaced downwardly through the valve. The valve is then closed when the assembly is displaced upwardly through the valve.

Some formation isolation valves are operated hydraulically using control lines which extend to the surface. Pressure applied to the control lines at the surface is used to open and close such valves. However, these long control lines have significant disadvantages. For example, long control lines are expensive to purchase and install, long control lines have increased susceptibility to damage during installation and leakage thereafter, etc.

Some formation isolation valves are operated by physical contact between the valve and the assembly as it is displaced through the valve. The assembly may engage and shift a sleeve or other device which causes a closure member of the valve to open. This physical contact has the disadvantage that it usually requires relatively small clearance between the valve and the assembly, which leads to a restriction in the interior of the valve.

Therefore, it may be seen that improvements are needed in the art. It is one of the objects of the present invention to provide such improvements. These improvements may also be useful in applications other than formation isolation valves for underbalanced drilling.

SUMMARY

In carrying out the principles of the present invention, methods and systems are provided which solve at least one problem in the art. One example is described below in which an actuator for a downhole well tool is remotely activated without the use of long control lines extending to the surface. Another example is described below in which the actuator is remotely activated without requiring any physical contact between the well tool and an assembly displaced through the well tool.

In one aspect of the invention, a method of operating a well tool in a well is provided. The method includes the steps of: positioning the well tool in the well, the well tool including an actuator; positioning a power source for the actuator in the well; and at a downhole position in the well remote from the actuator, causing the actuator to operate the well tool.

In another aspect of the invention, a well tool operating system is provided which includes a well tool with an actuator positioned downhole in a well. A device for causing the actuator to operate the well tool is also positioned downhole in the well. However, the device is positioned remote from the actuator.

In yet another aspect of the invention, a system for operating a formation isolation valve is provided. The system includes the formation isolation valve interconnected in a casing string and positioned downhole in a well. An assembly displaces through the casing string, such that displacement of the assembly through the casing string causes the valve to open prior to the assembly reaching the valve.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

Figure 1:
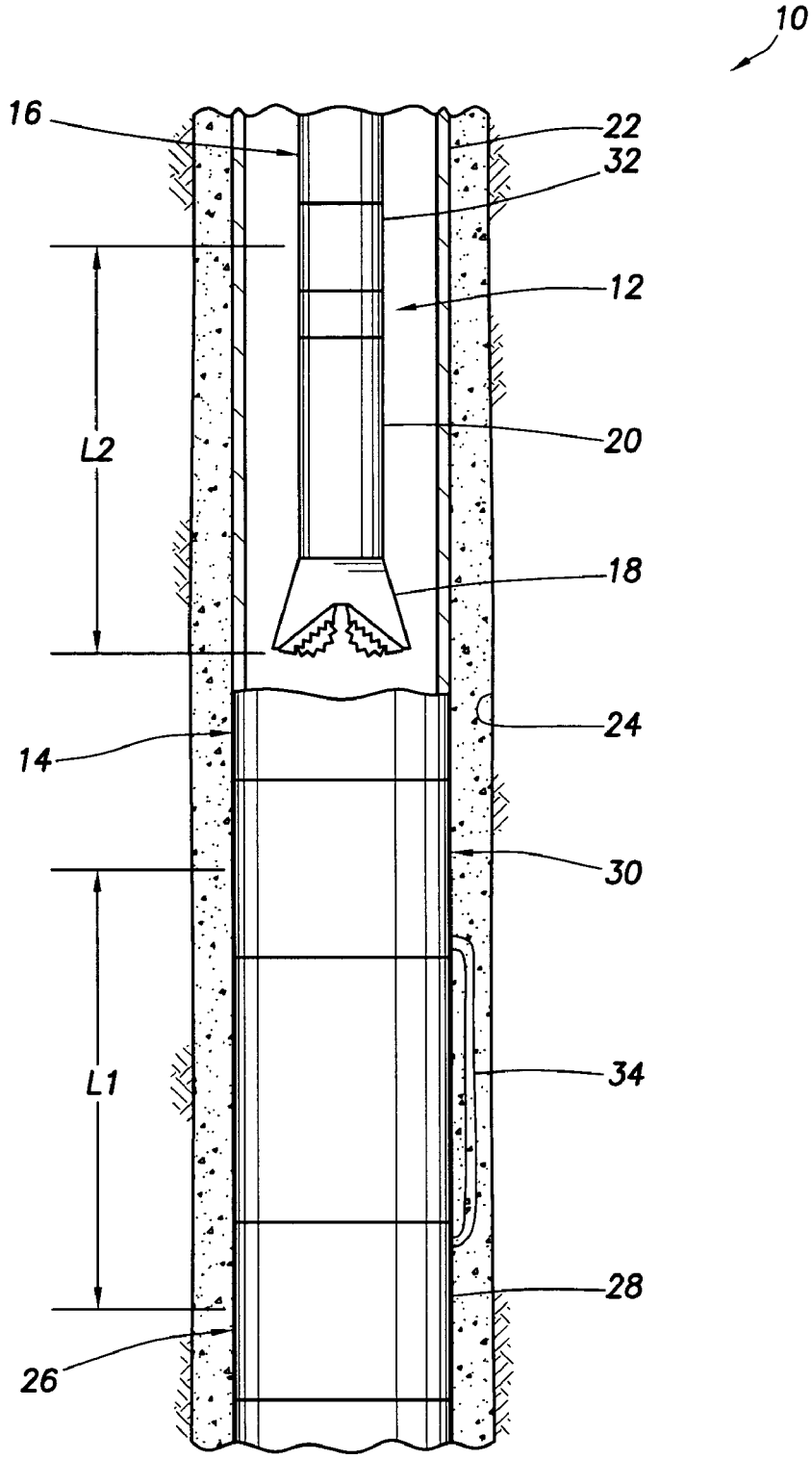
FIG. 1 is a schematic partially cross-sectional view of a method of operating a well tool, the method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings. In general, the downward direction is illustrated as being further from the earth's surface along a wellbore, and the upward direction is illustrated as being toward the surface, but it will be appreciated by those skilled in the art that, in actual practice, wellbores are seldom consistently vertical.

Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, an assembly 12 is being displaced downwardly through a tubular string 14. The assembly 12 is illustrated as comprising a drill string 16 having a drill bit 18 at a lower end. The drill string 16 may also include many other elements, such as a mud motor 20, etc.

The tubular string 14 is illustrated as comprising a casing string 22 which is cemented in a wellbore 24. As used herein, the term "casing string" is used to indicate any type of tubular string which is used to form a protective lining for a wellbore, and the term can include liner strings and other types of tubular strings made of any type of material.

A well tool 26 is interconnected in the casing string 22. The well tool 26 is illustrated as comprising a formation isolation valve 28. As the drill string 16 displaces downward toward the valve 28, the valve opens prior to the drill string reaching the valve.

Although the method 10 is described as including the step of displacing the drill string 16 through the casing string 22 to operate the valve 28, it should be clearly understood that this is only one example of an application of the principles of the invention. The assembly 12 is not necessarily a drill string (for example, the assembly could be a wireline conveyed tool, a coiled tubing string, or any other type of assembly). The assembly 12 does not necessarily have to be displaced through the tubular string 14. The tubular string 14 is not necessarily a casing string (for example, the tubular string could be a production tubing string, a coiled tubing string, or any other type of tubular string). The well tool 26 is not necessarily a formation isolation valve or any other type of valve (for example, the well tool could be a choke, a packer, a pump, a hanger, or any other type of well tool). Thus, it will be appreciated that the method 10 is but one example of a very wide variety of uses for the principles of the invention.

One of the important features of the method 10 is that the valve 28 is remotely operated, so that direct physical contact is not required between the valve and the drill string 16. Another important feature is that this remote operation is accomplished in the method 10 without requiring the use of long control lines extending from the surface to the valve 28.

The remote operation is accomplished in the method 10 by interconnecting a device 30 in the casing string 22 above the valve 28. For example, the device 30 may be remotely positioned a distance L1 above the valve 28. As the drill string 16 displaces through the device 30, the device causes an actuator of the valve 28 to operate the valve. In this manner, the device 30 activates the actuator (thereby causing the valve 28 to open) prior to the drill string 16 reaching the valve.

Preferably, the drill string 16 includes a device 32 which interacts with the device 30 to activate the actuator of the valve 28. The device 32 may be located a distance L2 above the lower end of the drill bit 18, with the distance L2 being less than the distance L1, so that the devices 30, 32 interact to activate the actuator to open the valve, prior to the drill bit reaching the valve 28 (or a closure member of the valve).

When the drill string 16 is displaced upwardly through the valve 28, the devices 30, 32 interact to activate the actuator to close the valve. In this manner, the valve 28 closes after the drill bit 18 has passed upwardly through the valve, thereby isolating a formation intersected by the wellbore 24 below the valve.

The device 30 is depicted in FIG. 1 as being connected to the valve 28 using lines 34 extending between the device and the valve external to the casing string 22. The lines 34 are described in more detail below as including hydraulic lines, but any type of communication between the device 30 and the valve 28 could be used (for example, pneumatic lines, electrical lines, optical lines, any form of telemetry (acoustic, electromagnetic, pressure pulse, etc.)) in keeping with the principles of the invention. It also is not necessary for the lines 34 to extend external to the casing string 22, since they could also, or alternatively, extend internal to the casing string, within a sidewall of the casing string, etc., or the lines may not be used at all if telemetry is used to communicate between the device 30 and the valve 28.

Figure 2:
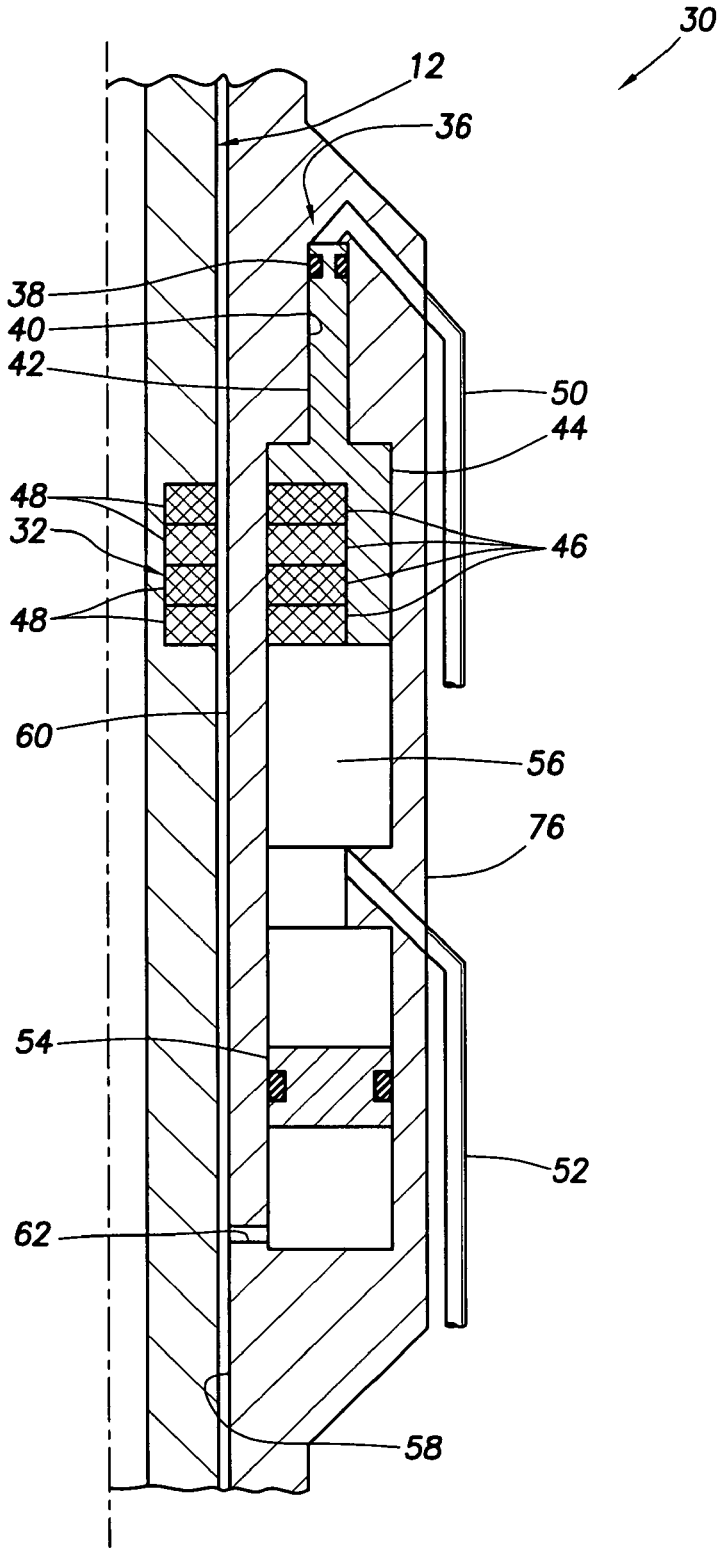
FIG. 2 is an enlarged scale schematic cross-sectional view of a device which may be used to remotely activate an actuator of a well tool in the method of FIG. 1.

Referring additionally now to FIG. 2, an enlarged schematic cross-sectional view of one possible construction of the device 30 is depicted with the assembly 12 being displaced through the device. In this construction of the device 30, a magnetic coupling is created between the assembly 12 and the device 30 in order to operate a power source 36 in the device.

The power source 36 includes a piston 38 reciprocably received in a bore 40 formed in an outer housing assembly 76 of the device 30. Thus, in this embodiment the power source 36 is a pump used to create a pressure differential to operate the valve 28. However, other types of power sources (such as electrical, mechanical, thermal, optical and other types of power sources) may be used in keeping with the principles of the invention.

The piston 38 is on a rod 42 which is attached to a cylindrical sleeve 44. A stack of annular shaped magnets 46 is carried on the sleeve 44.

The device 32 also includes a stack of annular shaped magnets 48 carried on the assembly 12. When the assembly 12 is displaced through the device 30, a magnetic coupling is created between the magnets 46, 48. This magnetic coupling permits a biasing force to be transmitted between the devices 30, 32 without requiring any physical contact.

When the magnetic coupling is created as depicted in FIG. 2 and the assembly 12 is displaced downward, a biasing force is exerted on the piston 38 (via the magnets 46, sleeve 44 and rod 42) to also displace the piston downward. This downward displacement of the piston 38 in the bore 40 causes a pressure differential to be created between lines 50, 52 connected to the device 30.

Specifically, pressure in the line 52 will be increased relative to pressure in the line 50. Of course, if the assembly 12 is displaced upwardly through the device 30, the magnetic coupling will be used to bias the piston 38 upward and thereby increase pressure in the line 50 relative to pressure in the line 52.

The lines 50, 52 may be included in the lines 34 depicted in FIG. 1. Since these lines 50, 52 only extend a relatively short distance (for example, approximately 20-30 meters) between the device 30 and the valve 28, they are significantly less susceptible to damage and leakage, and less expensive to purchase and install, as compared to control lines which extend perhaps thousands of meters to the surface.

Another beneficial feature of the device 30 is a balance piston 54 which ensures that pressure in an internal chamber 56 of the device 30 is equalized, via an opening 62, with pressure in an internal passage 58 through which the assembly 12 is displaced. In this manner, a wall 60 separating the magnets 46, 48 can be made relatively thin (since it does not have to withstand a large pressure differential), thereby increasing the biasing force which may be transmitted by the magnetic coupling.

Although the devices 30, 32 are illustrated as including magnets 46, 48 for transmitting a biasing force to the pump 36, these particular elements are not necessary in keeping with the principles of the invention. A magnetic field may be produced without the use of permanent magnets, for example, by using an electric coil, magnetostrictive materials, etc. A biasing force may be transmitted using a magnetic coupling without use of permanent magnets, for example, by using magnetostrictive materials, solenoids, etc.

Figure 4:
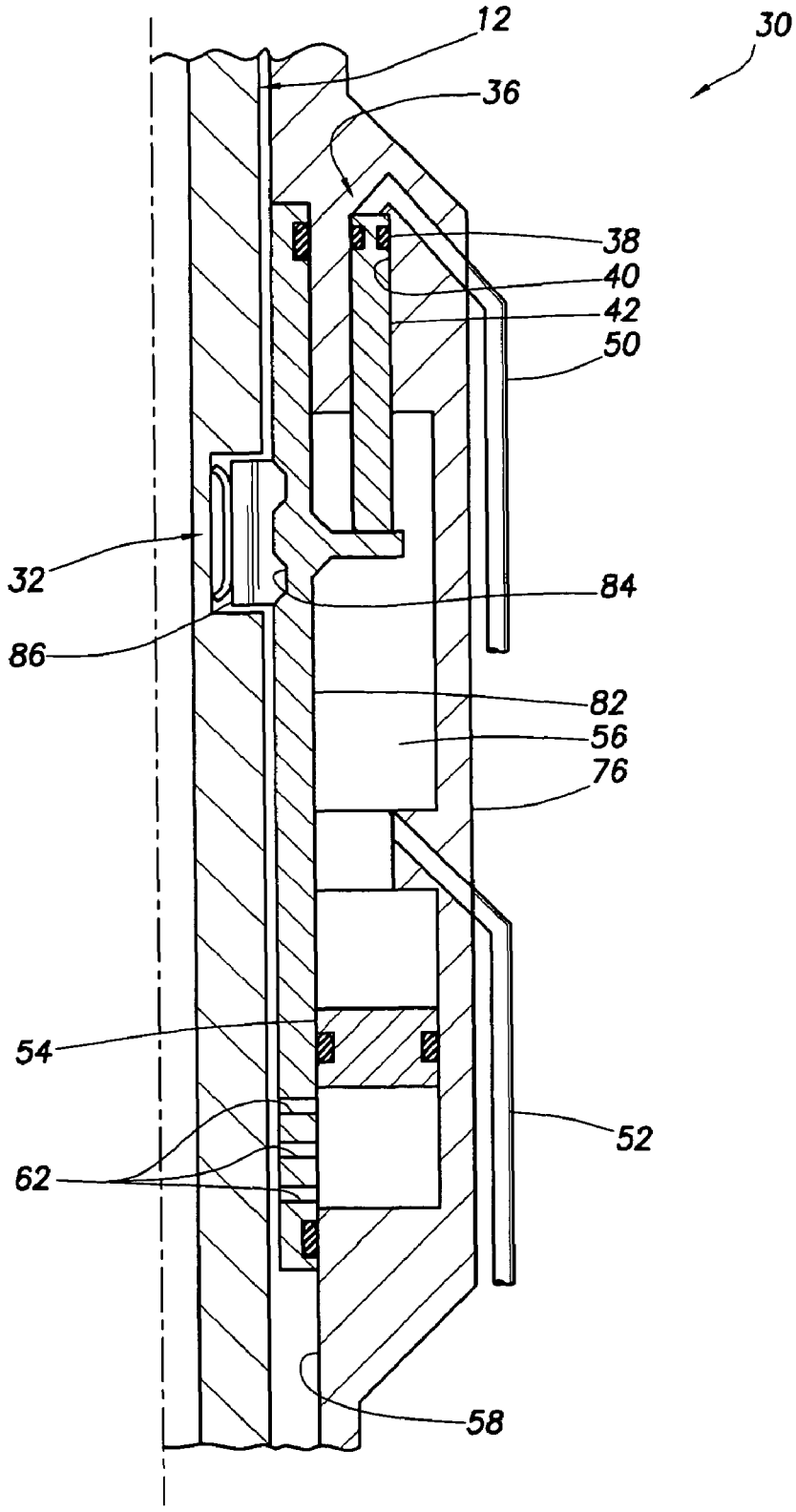
FIG. 4 is a schematic cross-sectional view of an alternate construction of the device of FIG. 2.

Furthermore, it is not necessary for a magnetic coupling to be used at all. A construction is illustrated in FIG. 4 and described below in which no magnetic coupling is used.

Figure 3:
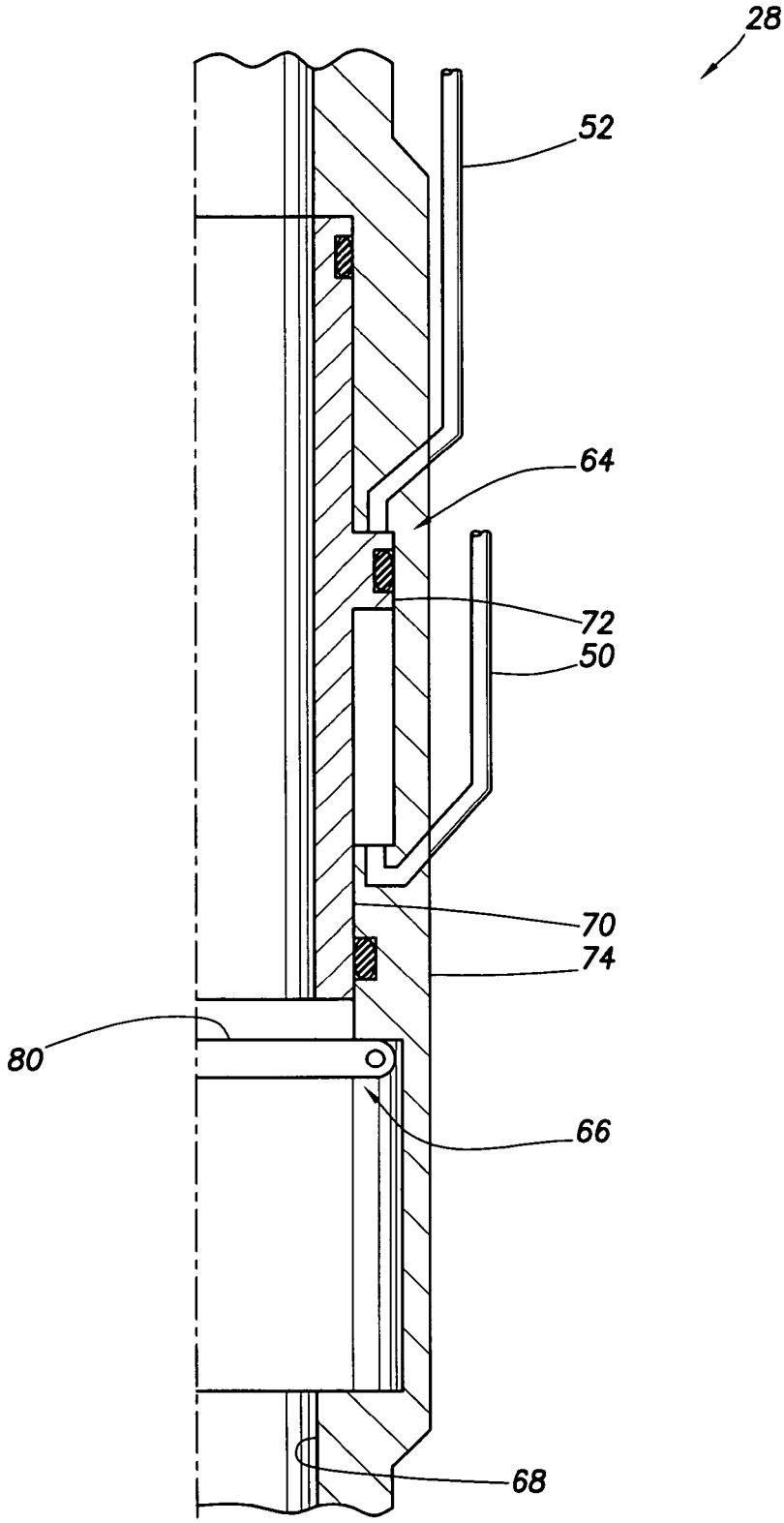
FIG. 3 is a schematic cross-sectional view of a well tool including an actuator which may be used in the method of FIG. 1.

Referring additionally now to FIG. 3, a schematic cross-sectional view of the valve 28 is representatively illustrated. The valve 28 includes an actuator 64 and a closure 66 for selectively permitting and preventing flow and access through a passage 68 formed through the valve.

The actuator 64 includes a sleeve 70 reciprocably and sealingly received in an outer housing assembly 74 of the valve 28. A radially enlarged piston 72 is formed on the sleeve 70. The lines 50, 52 are connected to the actuator 64 so that they communicate to below and above the piston 72, respectively. Thus, increased pressure in the line 52 relative to pressure in the line 50 will bias the sleeve 70 downward, and increased pressure in the line 50 relative to pressure in the line 52 will bias the sleeve upward.

The closure 66 includes a member 80 which functions to seal off the passage 68. The member 80 is illustrated as being a flapper, but it could be any type of sealing member, such as a ball, etc. The member 80 is preferably biased toward a closed position as shown in FIG. 3, for example, by use of a biasing device (such as a spring, gas charge, etc., not shown).

With the sleeve 70 in its upper position, the closure 66 is closed. When pressure in the line 52 is increased relative to pressure in the line 50 (by downwardly displacing the piston 38 as described above), the sleeve will displace downward. This downward displacement of the sleeve 70 will cause the closure 66 to open, for example, by pivoting the member 80 so that it no longer blocks access and flow through the passage 68.

When pressure in the line 50 is increased relative to pressure in the line 52 (by upwardly displacing the piston 38 as described above), the sleeve will displace upward. This upward displacement of the sleeve 70 will cause the closure 66 to close, for example, by allowing the member 80 to pivot across the passage 68 and again block flow and access through the passage.

A mechanism (not shown) may be provided for releasably maintaining the sleeve 70 in its upper and/or lower position. For example, a spring or other biasing device could be used to prevent the sleeve 70 from displacing downward due to its own weight when it is desired to keep the valve 28 closed. Alternatively, or in addition, a detent mechanism (such as a snap ring, collet, spring loaded detent, etc.) could be used to releasably secure the sleeve 70 in its upper and/or lower position.

Referring additionally now to FIG. 4, a schematic cross-sectional view of an alternate construction of the device 30 is representatively illustrated. This alternate construction is similar in many respects to the construction depicted in FIG. 2, and so the same reference numbers are used in FIG. 4 to indicate similar elements.

One significant difference between the constructions depicted in FIGS. 2 & 4 is that, instead of the wall 60, the construction of FIG. 4 has a sleeve 82 reciprocably and sealingly received in the housing assembly 76. The sleeve 82 is connected to the rod 42 so that the piston 38 displaces with the sleeve.

Another significant difference is that no magnetic coupling is used in the construction of FIG. 4. Instead, the assembly 12 biases the sleeve 82 to displace via engagement with a recessed profile 84 formed in the sleeve. The device 32 includes a key, dog or other engagement member 86 for engaging the profile 84.

As the assembly 12 displaces downwardly through the device 30, the member 86 engages the profile 84, thereby transferring a downward biasing force from the assembly to the sleeve 82. The piston 38 displaces downward with the sleeve 82, thereby increasing pressure in the line 52 relative to pressure in the line 50 and causing the actuator 64 to open the closure 66. The assembly 12 can then displace downward through the open valve 28.

Upward displacement of the assembly 12 through the device 30 will again cause the member 86 to engage the profile 84, thereby transferring an upward biasing force from the assembly to the sleeve 82. The piston 38 will displace upward with the sleeve 82, thereby increasing pressure in the line 50 relative to pressure in the line 52 and causing the actuator 64 to close the closure 66. The valve 28 will thus close after the assembly 12 has displaced through the valve.

Multiple openings 62 may be used to provide communication between the passage 58 and the balance piston 54. Filtering may be provided for the openings 62 to prevent debris, etc. from passing through the openings.

The alternate constructions of FIGS. 2 & 4 demonstrate that the invention may be practiced in a variety of different forms, and with or without use of a magnetic coupling. Use of the pump 36 to transfer fluid between the device 30 and the actuator 64 is also not required. For example, the actuator 64 could instead be an electrical actuator and the device 30 could include an electrical switch, so that when the assembly 12 displaces through the device, the switch is activated and causes electrical current to flow in the actuator to operate the valve 28.

If a magnetic coupling is used, the magnetic coupling could be used to activate an electrical switch or other device, instead of a pump.

It is not necessary for magnets to be carried on the assembly 12 if a magnetic coupling is used. For example, a sleeve which carries magnets thereon could be reciprocably mounted in the casing string 22. The magnets on this internal sleeve could be magnetically coupled to the magnets 46 carried on the sleeve 44 on an opposite side of the wall 60 (as in the construction of the device 30 depicted in FIG. 2). The assembly 12 as depicted in FIG. 4 could then be used to shift the internal sleeve (i.e., by engaging the member 86 with a profile formed in the sleeve) to cause displacement of the piston 38 or operation of an electrical switch, etc. to activate the actuator 64.

Another alternate construction could be used in which a radioactive source is carried on the assembly 12. The device 30 could include a radiation detector (for example, a gamma ray detector) to sense the presence of the radioactive source. When the radioactive source is detected, the device 30 could cause the actuator 64 to open or close the closure 66 as appropriate.

Another alternate construction could be used in which the device 30 includes a density sensor for detecting density in the passage 58. When the density sensor senses an increased density (due to the presence of the assembly 12 in the passage 58), the device 30 could cause the actuator 64 to open the closure 66. When the density sensor senses a decreased density (due to an absence of the assembly 12 in the passage 58) the device 30 could cause the actuator 64 to close the closure 66.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A method of operating a well tool in a well, the method comprising the steps of:

positioning the well tool in the well, the well tool including an actuator;

positioning a hydraulic power source for the actuator in the well; and at a downhole position in the well remote from the actuator, causing the actuator to operate the well tool by displacing an assembly past the power source, a piston of the power source thereby being forced to displace with the assembly, a force being transmitted directly from the assembly to the piston to cause displacement of the piston.

2. The method of claim 1, wherein the well tool is interconnected in a tubular string, and further comprising the steps of installing the assembly in the tubular string and displacing the assembly to the downhole position to operate the well tool.

3. The method of claim 2, wherein the step of causing the actuator to operate the well tool is performed without requiring physical contact between the assembly and the power source at the downhole position.

4. The method of claim 2, wherein the well tool is a valve which selectively permits and prevents flow through the tubular string.

5. The method of claim 4, wherein the assembly is a drill string, and wherein the displacing step further comprises displacing the drill string through the valve.

6. The method of claim 1, wherein the step of causing the actuator to operate the well tool further comprises forming a magnetic coupling in the well.

7. The method of claim 6, wherein the well tool is interconnected in a tubular string, and wherein the step of causing the actuator to operate the well tool further comprises displacing the assembly through the tubular string to thereby cause the magnetic coupling to displace.

8. The method of claim 7, wherein the assembly displacing step further comprises displacing a first magnetic device carried on the assembly.

9. The method of claim 1, wherein the power source is a pump.

10. The method of claim 9, wherein the step of causing the actuator to operate the well tool further comprises displacing the assembly through a tubular string in which the well tool is interconnected, thereby causing fluid transfer between the pump and the actuator.

11. A system for operating a formation isolation valve, the system comprising:

the formation isolation valve interconnected in a casing string and positioned downhole in a well; and an assembly which displaces through the casing string, displacement of the assembly through the casing string causing the valve to open prior to the assembly reaching the valve in response to the assembly applying a force to a piston of a power supply for an actuator of the valve, the force being transmitted directly from the assembly to the piston thereby causing displacement of the piston.

12. The system of claim 11, wherein the force transmitted directly from the assembly to the piston is generated by magnetic coupling.

13. The system of claim 11, wherein displacement of the assembly through the casing string operates a pump, thereby causing fluid transfer between the pump and the actuator of the valve.

14. The system of claim 11, wherein displacement of the assembly through the casing string activates a device positioned remote from the actuator of the valve, and wherein activation of the device causes the actuator to open the valve.

15. The system of claim 11, wherein displacement of the assembly through the casing string causes the valve to open without physical contact between the valve and the assembly.

* * * * *